US005160205A

United States Patent [19]

Mistyurik

[11] Patent Number: 5,160,205

[45] Date of Patent: Nov. 3, 1992

[54] THERMAL PRINTER WITH ADJUSTABLE INK RIBBON GUIDE ROLL

[75] Inventor: John D. Mistyurik, Troy, Ohio

[73] Assignee: Monarch Marking Systems, Inc., Dayton, Ohio

[21] Appl. No.: 716,172

[22] Filed: Jun. 17, 1991

[51] Int. Cl.[5] ..... B41J 33/32

[52] U.S. Cl. ..... 400/248; 400/120; 400/208

[58] Field of Search ..... 400/247, 248, 120, 224.2, 400/208, 208.1, 194, 196; 226/180

[56] References Cited

U.S. PATENT DOCUMENTS

| | | | |
|---|---|---|---|
| 1,098,407 | 6/1914 | Roberts | 400/642 |
| 4,007,865 | 2/1977 | Crandall | 226/180 |
| 4,673,304 | 6/1987 | Liu et al. | 400/208 |
| 4,768,890 | 9/1988 | Makino et al. | 400/120 |
| 4,776,714 | 10/1988 | Sugiura et al. | 400/248 |
| 4,997,298 | 3/1991 | Uchimura et al. | 400/242 |

FOREIGN PATENT DOCUMENTS

| | | | |
|---|---|---|---|
| 0189974 | 8/1986 | Japan | 400/248 |

OTHER PUBLICATIONS

"Ribbon Feeding Device" IBM Tech. Disclosure Bulletin, vol. 2, No. 5, Feb. 1960, p. 5.

"Adjustable Ribbon Tracking Device" IBM Tech. Disclosure Bulletin, vol. 16, No. 6, Nov. 1973 pp. 1751-1752.

*Primary Examiner*—Eugene H. Eickholt

*Attorney, Agent, or Firm*—Joseph J. Grass

[57] ABSTRACT

There is disclosed a thermal printer for printing on webs of record members such as tags and labels. The printer has a wide print head which can print on either a wide web or on a narrow web. When printing on a narrow web, pressure contact is relieved or minimized between the portion of the platen roll and printing elements beyond the side edge of the web to minimize wear as the platen roll rotates. This is accomplished by inclining the print head and platen roll relative to each other. In order to promote uniform tension in the ink ribbon, an adjustable guide is provided along the ink ribbon path. The guide can be adjusted in a flat plane. The guide is maintained perpendicular to the direction of ink ribbon travel and promotes uniformity of tension across the width of the ink ribbon and consequently enables tracking to be optimized.

9 Claims, 6 Drawing Sheets 39
37
67
64
65
68
40
79
78
38
80
81
88
86
85
83
82
84
66
103a
70
72
73
69
74
76
75
77
80a
114
60
63
59
42
41
61
58
51
50
49
102
103
94
92
97
101
100
99
98
54
62
56
44a
55
43
48
44'
44b
53
57
45
52
57'
46
47
71

THERMAL PRINTER WITH ADJUSTABLE INK RIBBON GUIDE ROLL

BACKGROUND OF THE INVENTION

1. Field of the Invention

This invention relates to the art of printing.

2. Brief Description of the Prior Art

The following U.S. patents are made of record: U.S. Pat. No. 1,098,407 granted Jun. 2, 1914 to Frank C. Roberts; U.S. Pat. No. 4,776,714 granted Oct. 11, 1988 to Ikuzo Sugiura et al; and U.S. Pat. No. 4,768,890 granted Sept. 6, 1988 to Kazunosuke Makino.

Prior art printers such as disclosed in U.S. Pat. No. 4,776,714 are adapted for printing on wide webs. The line of printing elements remains stationary and the platen roll rotates while the web of record members advances. When a wide web of record members is positioned between the printing elements and the platen roll, the printing elements are in printing cooperation with the rotating platen roll. The printing elements and the platen roll are urged toward each other to provide the proper printing pressure of the printing elements against the web of record members. The line of printing elements and the contact surface of the platen roll are generally parallel to each other. It is sometimes desirable to use such a printer, which is adapted to print on a wide web, to print on a narrow web. In this situation, the printing elements which overhang or extend beyond the side of the narrow web are abraded by the platen roll as the web advances through the printer. This causes excessive wear on some of the printing elements. The print head is a particularly expensive printer component. The platen roll is also abraded, which degrades the platen roll. Premature wearing out of either the print head or the platen roll causes service problems and/or downtime.

SUMMARY OF THE INVENTION

According to the invention, a thermal printer suitable for printing on a wide web is constructed so as to be also suitable for printing on a narrow web without causing significant degradation of the thermal print head or the platen roll.

It is a feature of the invention to position a thermal print head and a resilient platen roll relative to each other selectively so that in a first position all printing elements of the print head cooperate with a wide web and the platen roll and in a second position only some of the printing elements cooperate with a narrow web and the platen roll and the remainder of the printing elements make only light contact with the platen roll or are out of contact with the platen roll.

It is a feature of the invention that the print head is capable of printing on a wide web when the line of printing elements and the platen roll are essentially parallel, and there is structure for inclining the print head and the platen roll relative to each other to enable some of the printing elements to be in printing cooperation with a narrow web and the remaining printing elements which extend beyond the wide web make only light pressure contact with the platen roll or are spaced from the platen roll to obviate excessive wear on the remaining printing elements.

It is a feature of the invention to provide structure for skewing the print head and the platen roll relative to each other so that one portion of the platen roll and one set of printing elements corresponding thereto can print on a narrow web with adequate pressure contact and another portion of the platen roll contacts the other printing elements with reduced pressure contact or there is no contact to minimize abrasion of the other corresponding printing elements or the platen roll.

The invention also relates to an improved guide for an ink ribbon to promote accurate guiding or tracking of the ink ribbon.

It is a feature of the invention that the guide extend generally in a lateral orientation across and in guiding contact with the ink ribbon and there is structure for changing the inclination of the guide along a generally flat or straight planar path or plane while maintaining the guide in its lateral orientation.

It is a feature of the invention to provide a guide for an ink ribbon, wherein the guide includes a guide roll, a shaft for mounting the guide roll, and an adjusting device at one end portion of the guide roll for adjusting the position of the guide roll relative to the shaft, wherein the adjusting device includes structure for enabling the guide roll to be adjusted in a substantially flat plane to optimize tracking of the ink ribbon.

It is a feature of the invention to provide a guide for an ink ribbon which includes a stationary shaft cantilevered to the frame of a printer, a guide roll received about the shaft, and structure for adjusting the guide roll relative to the shaft for movement in a flat plane.

DETAILED DESCRIPTION OF THE PREFERRED EMBODIMENT

Figure 1:
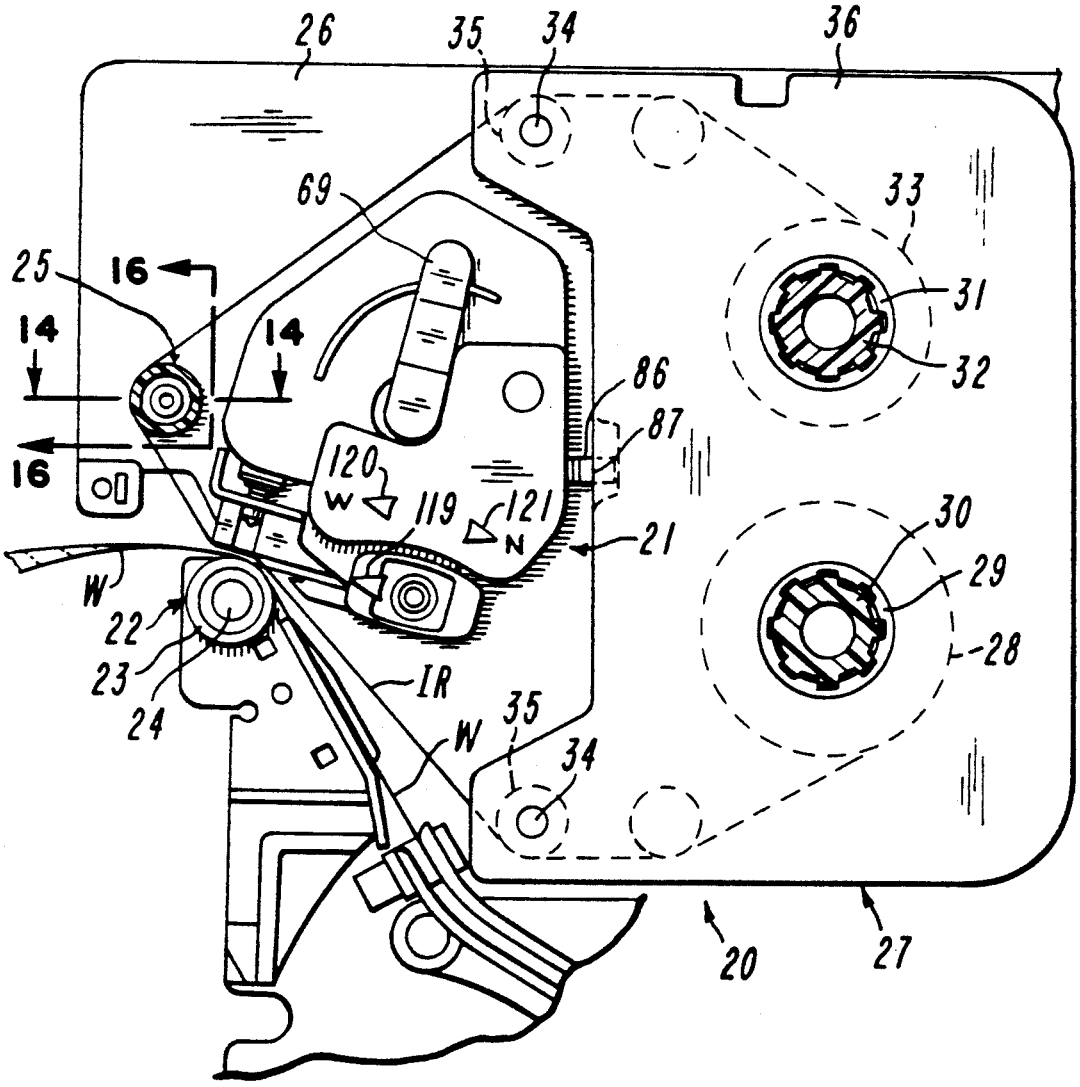
FIG. 1 is a fragmentary side elevational view of a thermal printer embodying the invention.

With reference to FIG. 1, there is shown a portion of a printer, for example a thermal printer 20 which contains the invention, but the printer 20 is otherwise like the printer disclosed in U.S. Pat. No. 4,776,714, assigned to Monarch Marking Systems, Inc., the assignee of the present application, and incorporated herein by reference. The printer 20 prints on a web W of record members such as tags or labels. The printer 20 includes a print head assembly 21 shown in greater detail in FIG. 2 and a platen 22 shown to take the form of a resilient rotatable platen roll 23 secured on a drive shaft 24.

The print head assembly 21, the platen roll shaft 24, and an ink ribbon guide 25 are cantilevered on a generally vertical frame plate 26. The guide 25 is generally parallel to the platen roll 23. An ink ribbon cartridge 27 is also mounted on the frame plate 26. The cartridge 27 has an ink ribbon supply roll 28 mounted on a supply spool 29 received on a spindle 30. The cartridge 27 also includes a take-up spool 31 on which the spent ink ribbon IR is wound. The take-up spool 31 is driven by a take-up spindle 32. The spool 31 mounts the take-up roll 33 of spent ink ribbon IR. Slight drag on the spindle 30 maintains tension in the ink ribbon IR between the platen roll 23 and the supply roll 28. The take-up spindle 32 rotates at a sufficiently high rate, irrespective of the diameter of take-up roll 33, so that the ink ribbon IR between the take-up roll 33 and the platen roll 23 is always under slight tension during operation of the printer 20. Parallel pins 34 cantilever-mounted on the frame plate 26 mount guides 35 which take the form of guide rolls. The guides 35 are loosely mounted on cartridge housing 36.

Figures 2, 3:
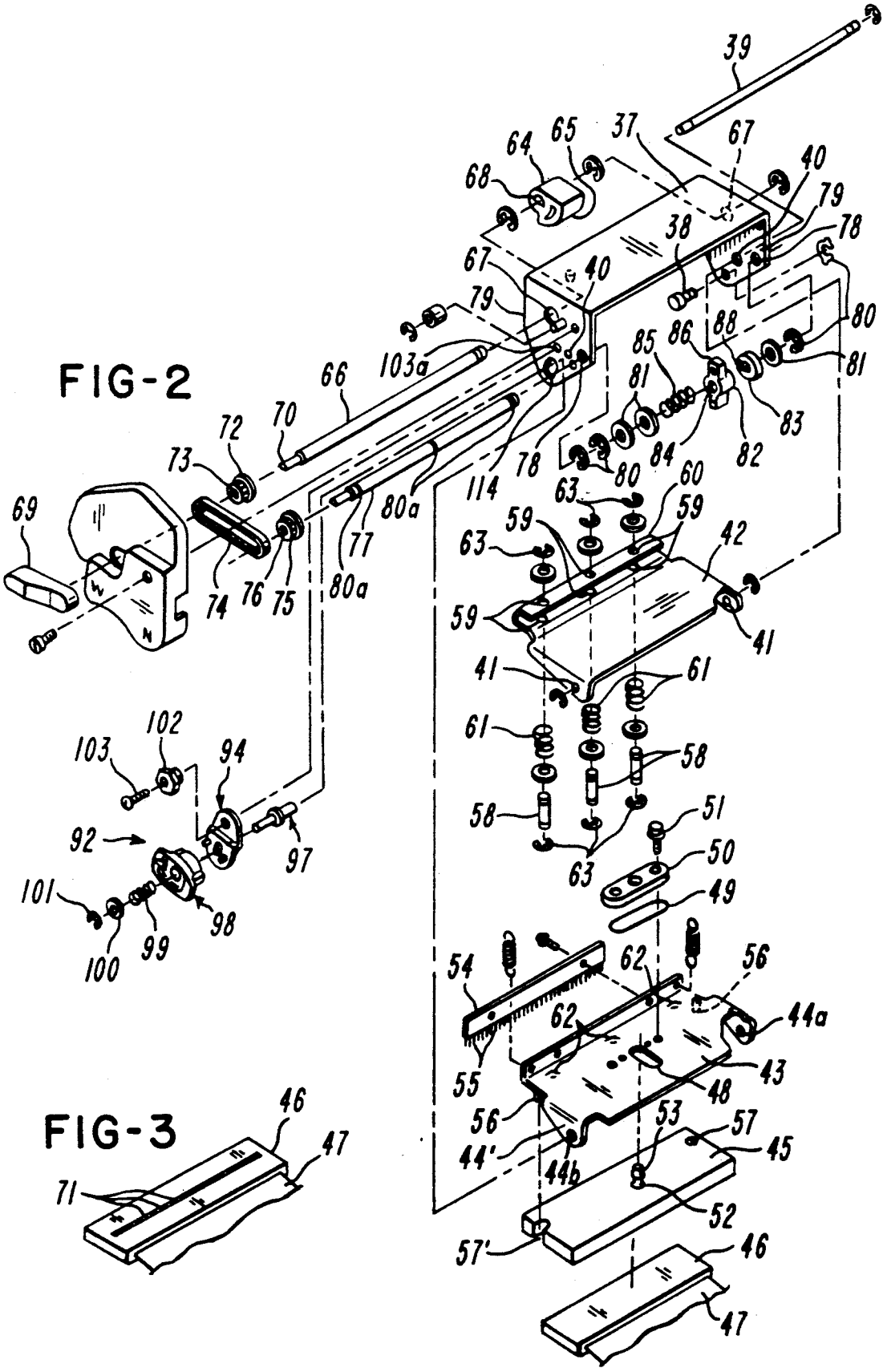
FIG. 2 is an exploded perspective view of a print head assembly according to the invention.
FIG. 3 is a perspective view of the underside of the thermal print head showing a line of printing elements.

With reference to FIG. 2, there is shown an inverted U-shaped bracket 37 suitably secured by a horizontal post (not shown but shown in FIGS. 4, 5 and 6 and 8 of U.S. Pat. No. 4,776,714) to the vertical frame plate 26 in a cantilevered manner. A rod or shaft 39 received in aligned holes 40 passes through aligned holes 41 in a pressure plate 42 to mount the pressure plate 42 for pivotal movement relative to the bracket 37. A mounting plate 43 is disposed below the pressure plate 42 and is mounted for pivotal movement on the bracket 37 by a pivot 38 and by an annular end portion 108 of a shaft 97. A support plate 45 is disposed below the mounting plate 43. The plate 45 supports a thermal print head 46 and serves as a heat sink for the print head 46. The print head 46 is connected to the electronics, forming no part of the present invention, through a ribbon connector 47. The print head 46 is suitably secured to the underside of the support plate 45. The plate 43 has an elongate slot 48. An endless resilient clip 49 is held in position across the slot 48 by a retainer 50. A pair of screws 51, only one of which is shown, holds the retainer 50 in position. An upstanding projection 52 having a head 53 passes freely through the slot 48 and the resilient clip 49 snaps in below the head 53. The print head 46 and its support plate 45 are, therefore, removably or releasably held on the mounting plate 43. A strip 54 having grounding elements 55 which contact the ink ribbon IR is secured to the plate 43. The strip 54 is grounded through the plates 42 and 43, the shaft 39, the U-shaped bracket 37, the horizontal post (not shown), and the vertical frame plate 26. The plate 43 has a pair of depending projections 56 which locate in a hole 57 and a notch 57' in the plate 45.

Three pins 58 pass through sets of respective aligned holes 59 in a U-shaped portion 60 of the plate 42. Springs 61 received loosely about the pins 58 bear against the underside of the U-shaped portion 60 and pins 58 bear against the upper face of the plate 43 at raised or convex areas 62. The springs 61 act to urge the plates 42 and 43 apart, that is, to pivot in opposite directions. E-rings 63 received on the pins 58 hold the springs 61 and the pins 58 assembled onto the plate 42.

A cam 64 having a cam face 65 bears against the upper surface of the pressure plate 42. The cam 64 is mounted on a rod or shaft 66 which passes through holes 67 in the bracket 37. The shaft 66 is D-shaped and extends through a D-shaped hole 68 in the cam 64. A lever or handle 69 is secured to end portion 70 of the shaft 66. Rotation of the lever 69 causes the cam 64 to move from the position shown in FIG. 2 in a clockwise direction to cause the plate 42 to be moved counterclockwise to compress the springs 61 and urge the plates 43 and 45 and the print head 46 toward the platen. Accordingly, rotation of the lever 69 as described moves the print head 46 from a position in which there is a gap between the print head 46 and the platen roll 23 to a position in which the print head 46 makes correct pressure contact against the ink ribbon IR which in turn results in the proper pressure contact between the ink ribbon IR and the web W at the nip between the print head 46 and the platen roll 23. As shown in FIG. 3, the underside of the print head has a line of thermal heating elements 71.

With reference to FIG. 2, a toothed wheel 72 having a D-shaped hole 73 is held securely on the shaft 66. A toothed belt 74 is engaged with the toothed wheel 72 and with a toothed wheel 75. The wheel 75 has a D-shaped hole 76 secured to a D-shaped shaft 77. The shaft 77 passes through aligned holes 78 in the bracket 37. The bracket 37 has depending arms 79. E-rings 80 are received in respective grooves 80*a* in the shaft 77. Washers 81 are also received on the shaft 77. A pair of jaw-type clutch members 82 and 83 are received on the shaft 77. The clutch member 82 has a round hole 84, and clutch member 83 has a D-shaped hole and is secured to the shaft 77. A compression spring 85 received about the shaft 77 urges the clutch member 82 against the clutch member 83 to normally hold the clutch members 82 and 83 clutched. The clutch member 82 has an integral locking member 86 which can move from a position shown in FIG. 2 to the position shown in FIG. 1 wherein the cartridge 27 is held locked in its loaded position. As shown, the locking member 86 passes in front of a flange or web 87 on the cartridge housing 36. When the lever 69 is operated from the position in FIG. 2 to the operating position shown in FIG. 1, the locking member 86 is moved to the locking position shown in FIG. 1 simultaneously with the operation of the cam 64 which moves the print head 46 into printing cooperating with the ink ribbon IR and the web W.

Should it happen that the cartridge 27 is not properly positioned in its operating position shown in FIG. 1, the locking member 86 could, for example, strike the web 87. The clutch provided by the clutch members 82 and 83 can slip as V-shaped element 88 on clutch member 83 moves out of V-shaped notch (not shown) on clutch member 82. This causes the clutch member 82 and its locking member 86 to slide axially on the shaft 77. This obviates damage to the components, or slipping of the teeth of the belt 74 and toothed wheels 72 and 75 which would result in loss of synchronism.

Figure 7:
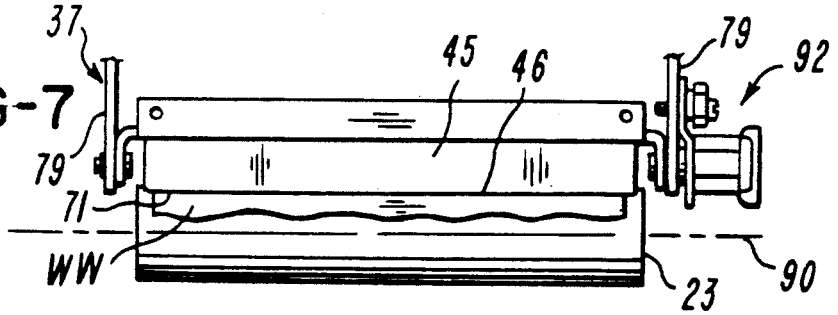
FIG. 7 is an elevational view showing the print head assembly coupled to the adjusting device, with a wide printable web between the print head and the platen roll, wherein the print head is in substantially uniform pressure contact with the platen roll.
Figure 8:
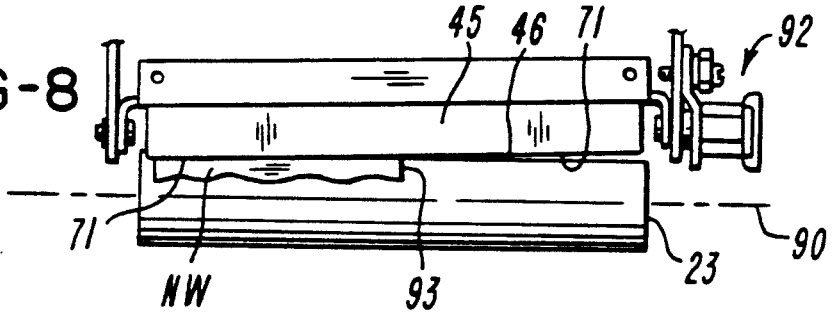
FIG. 8 is a view similar to FIG. 7, but showing the print head skewed or inclined relative to the platen roll and printing in a narrow web.

When the printer 20 is used to print on a wide web WW as shown in FIG. 7, it is seen that the print head 46 locally depresses the resilient platen roll 23 at the line of printing elements 71. As shown, the print head extends in essentially parallel relationship to axis 90 of the platen roll 23. An adjusting mechanism generally indicated at 92 holds the print head in this position relative to the bracket 37. The adjusting mechanism 92 will be described hereinafter in greater detail. On the other hand, in the event the printer 20 is to be used to print on a relatively narrow web NW, then the adjusting mechanism 92 is operated to hold the print head 46 skewed or inclined relative to the platen roll 23 as shown in FIG. 8. As shown, the narrow web NW is about one-half the width of the wide web WW. The narrow web NW is positioned at the left side as viewed in FIG. 8. The left side of the print head 46 compresses the left side of the platen roll 23 along the line of printing elements 71. The printing elements 72 on the right side (front side) of the printer beyond the narrow web NW makes little or no contact with the platen roll 23. Any slight amount of contact pressure between the platen roll 23 and the printing elements 72 beyond but close to the side edge 93 of the narrow web NW is tolerable, but obviously lack of any contact avoids all wear.

With reference to FIG. 2, the adjusting mechanism or device 92 is shown to comprise a plate 94 mounted to one arm 79 of the bracket 37. Also shown in FIG. 2 is a shaft 97, a manually engageable two-position selector or adjusting member 98, a compression spring 99, a washer 100, an E-ring 101, an eccentric 102 and a screw 103.

Figure 4:
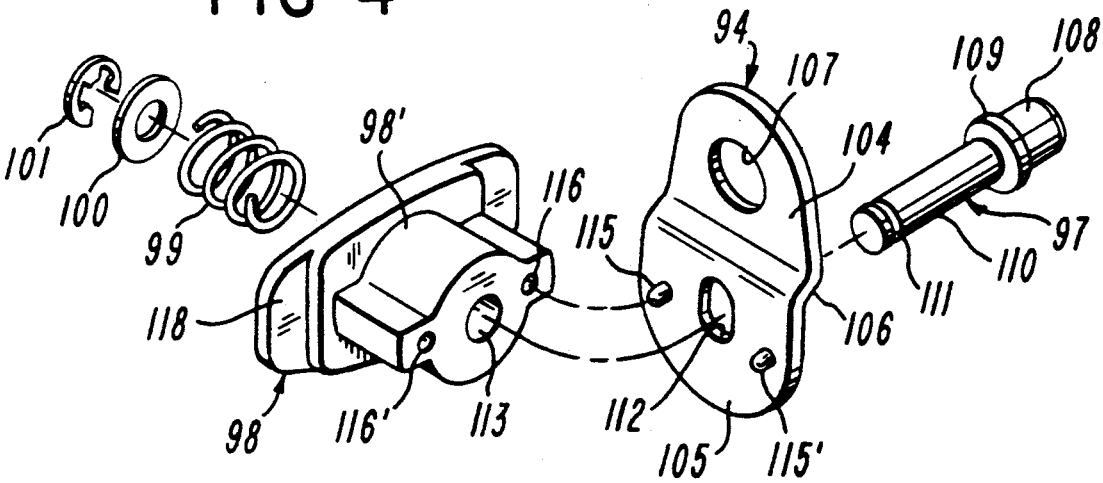
FIG. 4 is an exploded perspective rotated view showing an adjusting device for selectively skewing or inclining the print head.
Figure 6:
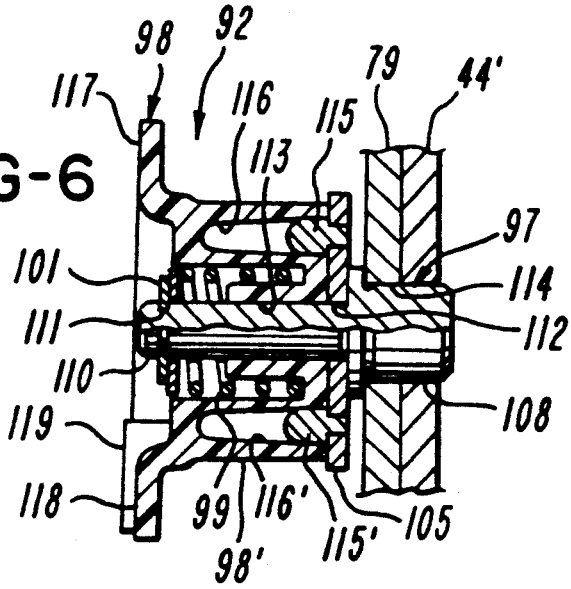
FIG. 6 is an assembled generally horizontal sectional view of the adjusting device.

With reference to FIGS. 2 and 4, the plate 94 is shown to have parallel planar portions 104 and 105 joined by a transition portion 106. The portion 104 has a circular hole 107 which receives an eccentric 102. The screw 103 passes through the eccentric 102 and is threaded into a hole 103*a* in the arm 79. The shaft 97 contains an annular end portion 108, a flange 109 having a greater diameter than the end portion 108, a reduced annular shaft portion 110 and an annular groove 111 in the shaft portion 110. The flange 109 is in contact with one side of the planar portion 105 as also shown in FIG. 6. The shaft portion 110 extends through an elongate slot or hole 112 in the planar portion 105, through a bore 113 in the adjusting member 98, and through the spring 99 and the washer 100. The E-ring 101 received in the groove 111 and the washer 100 retain the adjusting member assembled as shown in FIG. 6. The portion 108 of the shaft 97 extends through an elongate slot 114 in the arm 79. As shown in FIG. 6, the slot 114 is just wide enough for the shaft portion 108 to slide in either direction in the slot 114. The shaft portion 108 extends into the hole 44*b* in tab 44' of the plate 43. There is a relatively close but rotating fit between the shaft portion 108 and the hole 44*b*. The slot 114 is long enough to enable the adjusting mechanism 92 to make the full range of adjustment contemplated by the invention.

Figure 5:
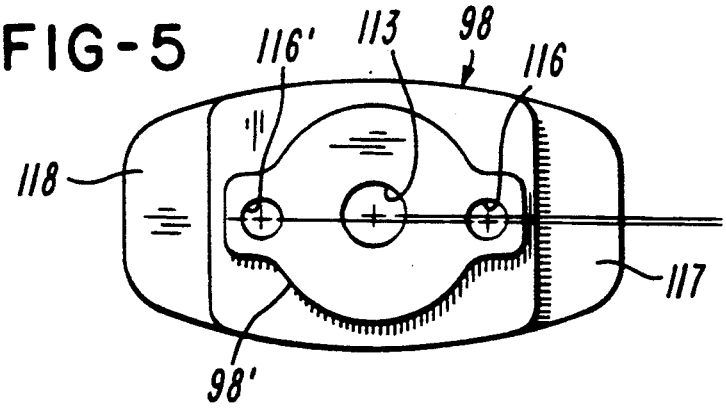
FIG. 5 is an enlarged elevational view of one part of the adjusting device showing offset between holes.
Figure 9:
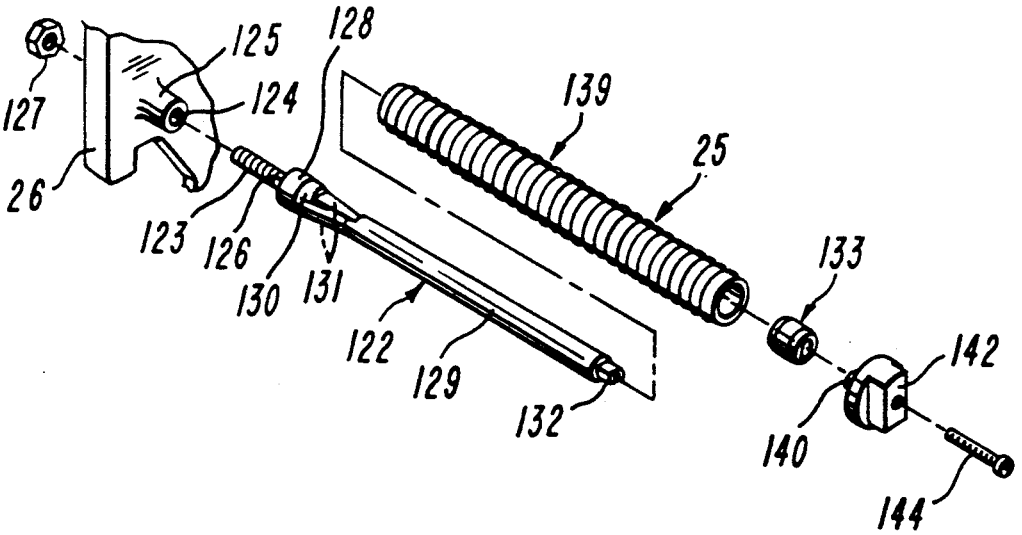
FIG. 9 is an exploded perspective view of a guide for an ink ribbon.

The shaft portion 110 makes a sliding fit with the sides of the slot 112, however the slot 112 is long enough to allow the full range of adjustment. The shaft portion 110 is sized so that the adjusting member 98 can rotate thereon, but the fit is close enough to assure positional accuracy. The plate portion 105 has a pair of parallel pins 115 and 115' adapted to be received in holes 116 and 116' in the adjusting member 98. As best shown in FIG. 6, the pins 115 and 115' are in respective holes 116 and 116', but sliding the adjusting member 98 to the left causes the spring 99 to be compressed and causes the pins 115 and 115' to clear the holes 116 and 116'. The adjustment is made by rotating the adjusting member 180 degrees to that the pin 115 is approximately aligned with the hole 116' and the pin 115' is approximately aligned with the hole 116. The rounded ends on the pins 115 and 115' cam the approximately aligned pins 115 and 115' into respective holes 116' and 116. Then the spring 99 causes the adjusting member 98 to move to the right so that the pins 115 and 115' enter respective holes 116' and 116. As seen in FIG. 5, the center of the hole 113 is above the level of the holes 116 and 116'. When the adjusting member 98 is in a position such that the pin 115 is in the hole 116 and the pin 115' is in the hole 116', then the shaft 97 is in elevated position (FIG. 8) for printing on a narrow web NW. Conversely, when the adjusting member 98 is rotated 180 degrees to be in a position that the pin 115 is in the hole 116' and the pin 115' is in the hole 116, then the shaft 97 is in a lowered position (FIG. 7) for printing on a wide web WW. It is apparent that pulling on ears 117 and 118 of the adjusting member 98 against the force of the compression spring 99 will cause the pins 115 and 115' to be clear of holes 116 and 116'. When the adjusting member 98 is rotated through 180 degrees until the pins 115 and 115' are approximately aligned with holes 116 and 116' (or 116' and 116 as the case may be) and the ears 117 and 118 are released so that the spring 99 can cause the pins 115 and 115' to be cammed into the holes 116 and 116' (or 116' and 116 as the case may be), then the shaft will be selectively shifted to a different position and held or locked in that adjusted position. The ear 118 has a pointer 119 (FIGS. 1 and 6) which points in the direction of arrow 120 for a wide web WW as indicated by the designation "W" in FIG. 1 or preferably the designation "WIDE" and which points in the direction of arrow 121 for a narrow web NW as indicated by the designation "N" in FIG. 1 or preferably the designation "NARROW". Raising or lowering of the shaft 97 along the slot 114 which is slightly inclined with respect to the vertical as shown in FIG. 1 causes one side of the support plate 43 to be correspondingly raised or lowered. The raised position of the plate 43 causes the mounting plate 45 and the print head 46 to be in the position shown in FIG. 8, and the lowered position of the plate 43 causes the mounting plate and the print head 46 to be in the position shown in FIG. 7. There is enough play or clearance in the parts to enable this inclining or skewing of the plate 43 and in turn the plate 45 and print head 46. Thus, by simply pulling on the adjusting member 98 and rotating the adjusting member 98 through 180 degrees and then releasing the adjusting member 98, the printer 20 is conditioned to print on either a wide web or a narrow web, without causing excessive degradation of the print head and/or the platen roll. It is apparent that the adjusting mechanism 92 serves to lock the print head 46 and associated mounting structure in either selected position. With reference to FIGS. 1 and 9, the guide 25 is provided to optimize the tracking of the ink ribbon IR. The guide 25 is simple in construction, yet it accomplishes the purposes of the invention. The guide 25 is shown in FIGS.

Figure 12:
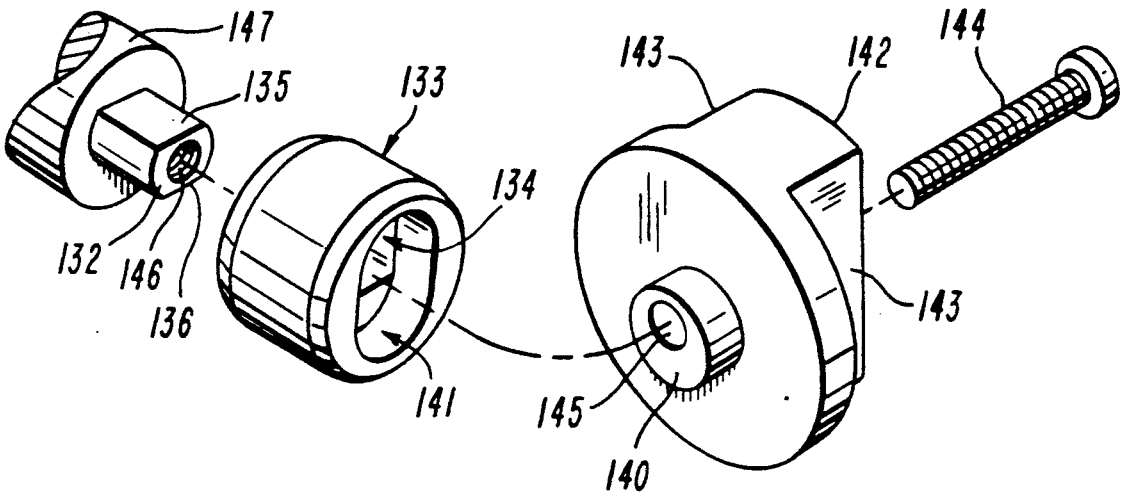
FIG. 12 is an exploded perspective rotated view showing a portion of a mounting shaft, a bearing, an eccentric and its driver, and a fastener.
Figure 13:
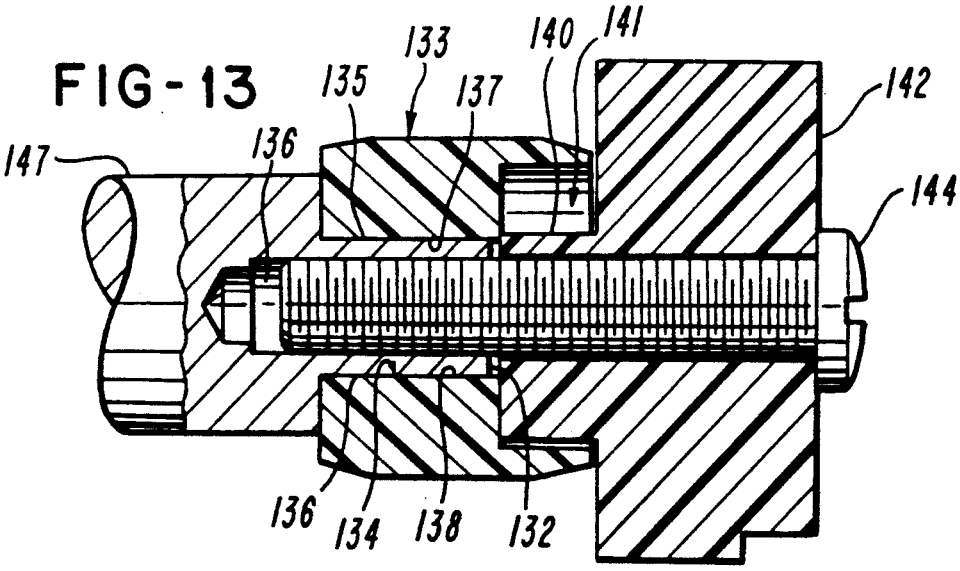
FIG. 13 is an enlarged vertical sectional assembled view of the components shown in FIG. 12.

9 and 14 to include a stationary cantilevered shaft 122 having a threaded end portion 123. The end portion 123 projects through bore 124 of a boss 125 on the frame plate 26. The shaft 122 has a shoulder 126. A nut 127 threadably received on the threaded end portion 123 secures the shaft 122 to the frame plate 26 by drawing the shoulder 126 against the end of the boss 125. The shaft 122 has an annular portion 128 immediately adjacent the shoulder 126. A substantial portion of the length of the shaft is comprised by a main portion 129. A generally tapered portion 130 joins the annular portion 128 and the main portion 129. The tapered portion 130 provides a smooth transition so that the shaft 122 is not unduly weakened. Opposite sides of the tapered portion 130 have flats 131 to enable the shaft 122 to be held in the desired annular position while the nut 127 is being tightened. The flats 131 are positioned horizontally. The free end of the main portion 129 has a non-circular generally rectangular guide or pin 132 shown in greater detail in FIG. 12. A bearing or mounting 133 has a horizontal rectangular hole 134 which receives the guide 132 as best shown in FIG. 13.

Figure 10:
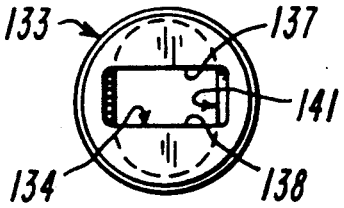
FIG. 10 is an elevational view showing one end of a bearing shown in FIG. 9.
Figure 11:
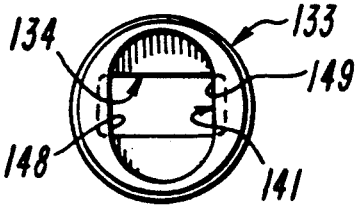
FIG. 11 is an elevational view showing the other end of the bearing.

Because the horizontal width of the hole 134, seen in FIG. 10, is greater than the horizontal extent of the guide 132, the bearing 133 is capable of moving horizontally on and with respect to the guide 132, however, because of the parallel, flat upper and lower surfaces 135 and 136 of the guide 132 slidably received between parallel, flat upper and lower surfaces 137 and 138 of the hole 134, the bearing 133 cannot rotate with respect to shaft 122. Opposite end portions of a guide roll 139 are rotatably mounted on the annular portion 128 and on the bearing or mounting member 133. An eccentric or cam 140 is received in an elongate slot 141 in the mounting member 133. The long dimension of the slot 141 extends perpendicular to the long dimension of the slot 134. As shown, the slots 134 and 141 open into each other. The eccentric 140 has an integrally molded handle or driver 142 having flats 143 on opposite sides to enable manual or wrench-assisted rotation. A fastener in the form of a screw 144 passes freely through a hole 145 in the eccentric 140 and is threadably received in a threaded bore 146 in the guide 132 and end portion 147 of the shaft 122. When the screw 144 is loosened, the eccentric 140 may be rotated by engaging the flats 143. Rotation of the eccentric 140 causes the mounting member 133 to slide horizontally either to the right or left depending on the direction of rotation. It is noted that the outside diameter of the eccentric 140 is only slightly less than the narrow dimension of the slot 141 (between walls 148 and 149 to allow for normal clearance. Thus, any rotation of the eccentric 140 will cause the mounting member 133 to translate horizontally. However, as shown in FIG. 13 the length of the slot 141 is substantially greater than the outside diameter of the eccentric 140.

Figure 14:
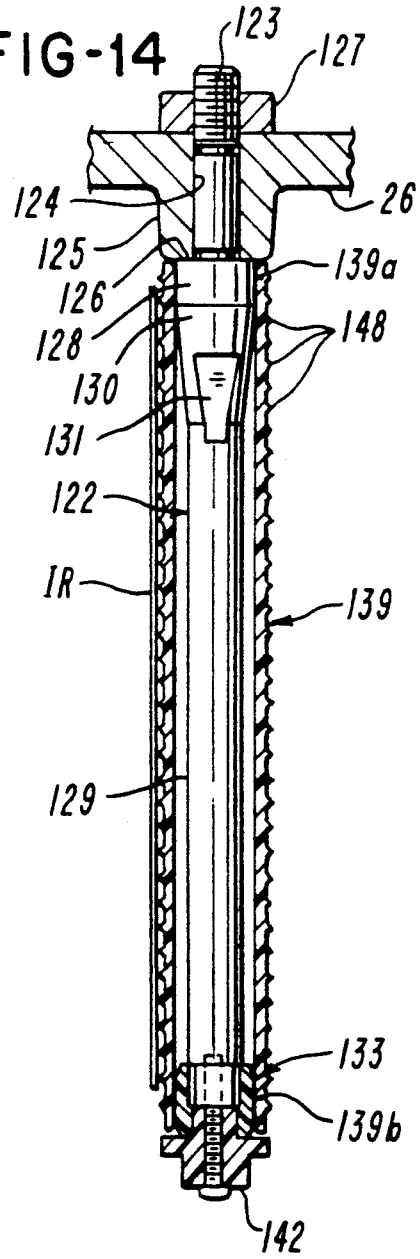
FIG. 14 is an enlarged horizontal sectional view taken generally along line 14—14 of FIG. 1 showing the guide roll in one adjusted position relative to the mounting shaft.
Figure 15:
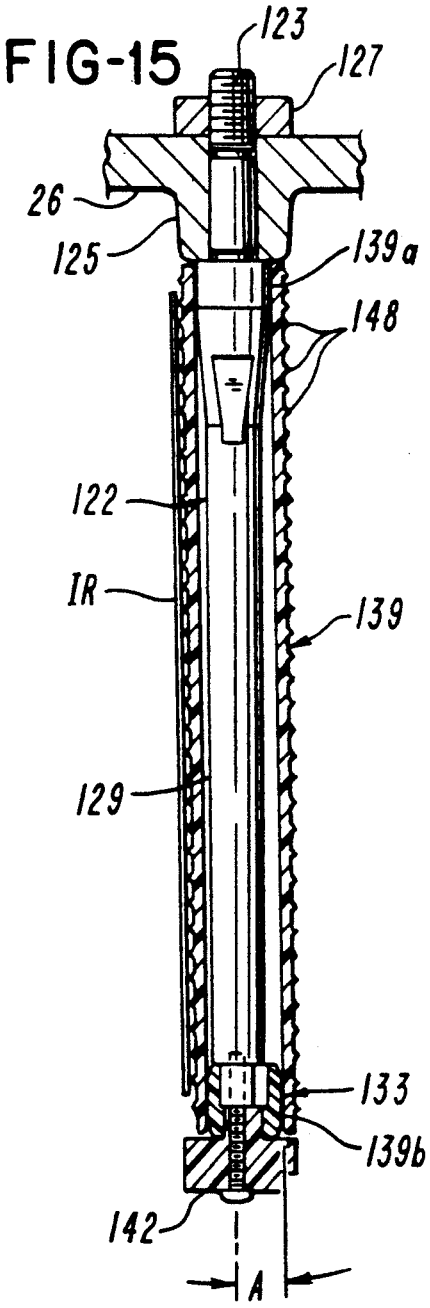
FIG. 15 is a view similar to FIG. 14, but showing the guide roll in another adjusted position relative to the mounting shaft.

The shaft 122 remains perpendicular to the frame plate 26 as shown for example in FIGS. 14 and 15. FIG. 14 illustrates the guide roll 139 as being perpendicular to the frame plate or coaxial with the shaft 122. FIG. 15 illustrates the guide roll 139 as being skewed or inclined relative to the shaft 122 so that the axis of the guide roll 139 makes an angle A with the axis of the shaft 122. This adjustment can be made to maintain the proper, uniform tension across the ink ribbon IR with the goal of optimizing the tracking of the ink ribbon IR. The driver 142 and its cam or eccentric 140 can be rotated through 360 degrees. It is apparent that the guide roll 139 can also move in the flat plane to the left of the centerline of the shaft 122, instead of to the right of the centerline of the shaft 122, as viewed in FIG. 15. The travel of the guide roll 139 can thus be through twice the angle A. Notwithstanding the adjustment of the guide roll 139, the end portion 139*a* is able to rotate on the annular portion 128 due to clearance and a certain resilience in the material of which the guide roll 139 is composed and the thinness of the guide roll 139. Likewise, end portion 139*b* is able to rotate on the bearing 133 in the different adjusted positions of the guide roll 139. The bearing 133 is preferably crowned or rounded on its outer surface, as shown.

Figure 16:
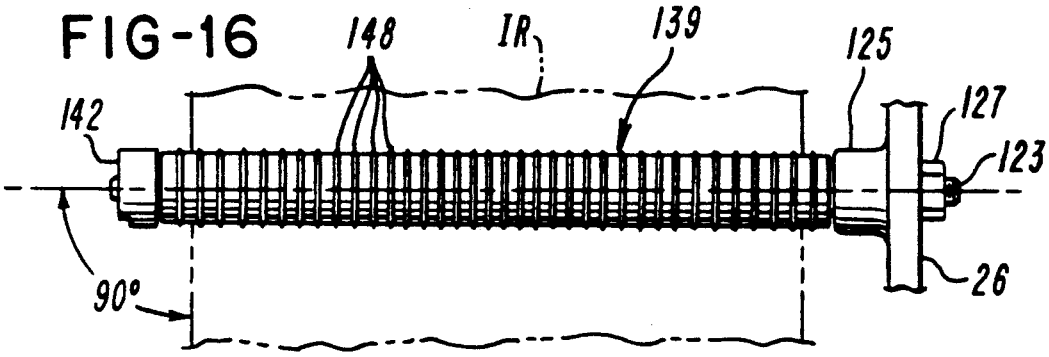
FIG. 16 is a vertical sectional view taken generally along line 16—16 in FIG. 1, showing the guide extending laterally of or perpendicularly to the direction of travel of the ink ribbon.

Reference to FIG. 16 shows that irrespective of the adjustment of the guide 25, the guide 25 always remains perpendicular to the direction of travel of the ink ribbon IR as shown by the 90° angle reference. Thus, the guide 25 can be adjusted to cause the web to be at the desired tension across the width of the web of the ink ribbon without adversely affecting the tracking of the web. Thus, the guide 25 serves to maintain proper tracking while maintaining proper tension in the ink ribbon IR.

The guide roll 139 is preferably composed of molded plastics material. The mounting member 133 and the eccentric 140 (with its driver 142) can be composed of either metal or plastics material. The guide roll 139 has spaced, annular rings or ridges 148 at its outer periphery which help guide the ink ribbon.

Although references are made to "horizontal" and "vertical" with reference to a specific embodiment of the invention, there is no intention to thereby limit the invention.

Other embodiments and modifications of the invention will suggest themselves to those skilled in the art, and all such of these as come within the spirit of this invention are included within its scope as best defined by the appended claims.

I claim:

1. A thermal printer, comprising: a frame, a thermal print head and a cooperable platen mounted to the frame, a guide for an ink ribbon, the ink ribbon being guided from a supply roll, to between the print head and the platen, partially about the guide and to a take-up roll, the guide extending generally in a lateral orientation across and in guiding contact with the ink ribbon, and means for changing the inclination of the guide along a generally straight planar path while maintaining the guide in its lateral orientation to provide substantially uniform tension across the web.

2. The invention as defined in claim 1, wherein the platen includes a platen roll, and the guide extends generally parallel to the platen roll.

3. A thermal printer, comprising: a frame, a print head and a cooperable platen mounted to the frame, a guide for an ink ribbon, the ink ribbon being guided from a supply roll, to between the print head and the platen, partially about the guide and to a take-up roll, the guide including a guide roll, a shaft for mounting the guide roll, an adjusting device at one end portion of the guide roll for adjusting the position of the guide roll relative to the shaft, and wherein the adjusting device includes means for enabling the one end portion of the guide roll to be adjusted in a substantially flat plane.

4. The invention as defined in claim 3, wherein the shaft has an annular outer surface for supporting the other end portion of the guide roll.

5. The invention as defined in claim 3, wherein the adjusting device includes a bearing received inside the guide roll, wherein the bearing includes a guide slot and a follower slot, the shaft having a guide received in the guide slot for confining the bearing to linear movement, a driver, the driver including an eccentric received in the follower slot, the driver being rotatably secured to the shaft, whereby rotation of the driver causes the eccentric to act on the follower slot to move the bearing in a substantially flat plane.

6. A thermal printer, comprising: a frame, a print head and a cooperable platen mounted to the frame, a guide for an ink ribbon, the ink ribbon being guided from a supply roll to between the print head and the platen, partially about the guide and to a take-up roll, the guide including a stationary shaft cantilevered to the frame, a guide roll received about the shaft, and means for adjusting the guide roll relative to the shaft for movement in a flat plane.

7. A thermal printer as defined in claim 6, wherein the adjusting means includes an eccentric, a bearing received on the shaft for mounting the guide roll, the bearing including a follower slot for receiving the eccentric, the bearing further including a guide slot, and the shaft terminating in a non-circular guide pin received in the guide slot.

8. A thermal printer, comprising: a frame, a thermal print head and a cooperable platen mounted to the frame, a guide for an ink ribbon, the ink ribbon being guided from a supply roll, to between the print head and the platen, partially about the guide and to a take-up roll, the guide extending generally in a lateral orientation across and in guiding contact with the ink ribbon, and means for changing the inclination of the guide along a generally flat planar path while maintaining the guide in its lateral orientation to provide substantially uniform tension across the web, wherein the inclination changing means includes a cooperating pin and slot for confining the guide for generally horizontal movement.

9. A thermal printer, comprising: a frame, a thermal print head and a cooperable platen mounted to the frame, a guide for an ink ribbon, the ink ribbon being guided from a supply roll, to between the print head and the platen, partially about the guide and to a take-up roll, the guide extending generally in a lateral orientation across and in guiding contact with the ink ribbon, means for changing the inclination of the guide along a generally flat planar path while maintaining the guide in its lateral orientation to provide substantially uniform tension across the web, wherein the guide further includes a shaft cantilevered to the frame, a guide roll received about the shaft, the guide roll having opposite end portions, wherein the inclination changing means includes a cam at the one end portion of the guide roll, and means on the shaft for supporting the other end portion of the guide roll.

* * * * *